United States Patent [19]

Oda

[11] Patent Number: 4,784,617

[45] Date of Patent: Nov. 15, 1988

[54] ELECTRICAL CONNECTOR HAVING POSITIONING MEMBER TO ALIGN CONTACT SECTIONS OF ELECTRICAL CONTACTS

[75] Inventor: Kenzo Oda, Tokyo, Japan

[73] Assignee: AMP Incorporated, Harrisburg, Pa.

[21] Appl. No.: 30,771

[22] Filed: Mar. 25, 1987

[30] Foreign Application Priority Data

May 30, 1986 [JP] Japan ..... 61-082421[U]

[51] Int. Cl.[4] ..... H01R 13/426

[52] U.S. Cl. ..... 439/595; 439/686

[58] Field of Search ..... 439/374, 375, 733, 744, 439/745, 746, 747, 748, 749, 752, 595, 686, 690, 695

[56] References Cited

U.S. PATENT DOCUMENTS

| | | | |
|---|---|---|---|
| 3,394,339 | 7/1968 | Gaskievicz et al. | 439/733 |
| 3,487,355 | 12/1969 | Cairns | 439/686 |
| 3,501,736 | 3/1970 | Norris | 439/353 |
| 3,601,760 | 8/1971 | Cairns | 439/595 |
| 3,670,290 | 6/1972 | Angele et al. | 439/733 |
| 3,686,619 | 8/1972 | McCardell, Jr. et al. | 439/595 |
| 3,937,545 | 2/1976 | Cairns et al. | 439/272 |
| 3,970,352 | 7/1976 | Dorrell et al. | 439/595 |
| 3,971,613 | 7/1976 | Kobler | 439/595 |
| 4,343,523 | 8/1982 | Cairns et al. | 439/588 |
| 4,391,483 | 7/1983 | Desourgeaux | 439/275 |
| 4,402,566 | 9/1983 | Powell et al. | 439/752 |
| 4,544,220 | 10/1985 | Aiello et al. | 439/747 |
| 4,557,542 | 12/1985 | Coller et al. | 439/748 |
| 4,565,416 | 1/1986 | Rudy et al. | 439/592 |
| 4,571,017 | 2/1986 | Fujita | 439/744 |
| 4,588,242 | 5/1986 | McDowell et al. | 439/589 |
| 4,705,339 | 11/1987 | Hayes et al. | 439/747 |

FOREIGN PATENT DOCUMENTS

| | | |
|---|---|---|
| 1491217 | 11/1977 | United Kingdom . |
| 2024538 | 1/1980 | United Kingdom . |
| 2081526 | 2/1982 | United Kingdom . |

OTHER PUBLICATIONS

"Multiple Interlock Connectors (MIC) Mark I and Mark II", AMP Catalog 86-783 issued 2-87.
Drawing No. 643724, "Plug II Posn, MIC Mark II".
Drawing No. C-172775 (Mark II MIC).
Samples-Housing & Terminals (Mark II MIC).

*Primary Examiner*—Gil Weidenfeld
*Assistant Examiner*—Gary F. Paumen
*Attorney, Agent, or Firm*—Robert W. Pitts

[57] ABSTRACT

An electrical connector comprises a dielectric housing member having contact receiving passages in which electrical contact members are disposed. The resilient latching arms extend from walls of the contact receiving passages in engagement with contact members thereby retaining the contact members in position in the contact receiving passages with spaces being located between the latching arms and the walls of the contact receiving passages. A retaining member is located in the housing member and has projections disposed in the spaces between the passage walls and the latching arms thereby maintaining the latching arms in engagement with the contact members. Housing member includes a cavity along which retaining member extends. Retaining member has an inner wall including positioning holes through which contact sections of contact members extend into and along cavity with positioning holes serving to align contact sections when retaining member is positioned in cavity.

14 Claims, 2 Drawing Sheets

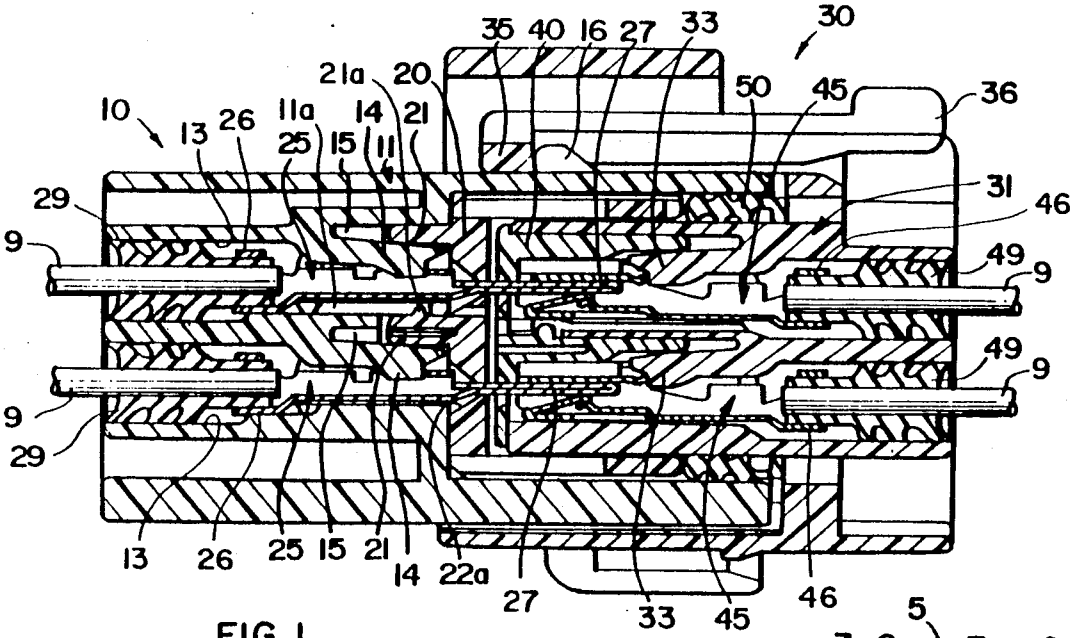
FIG. 1
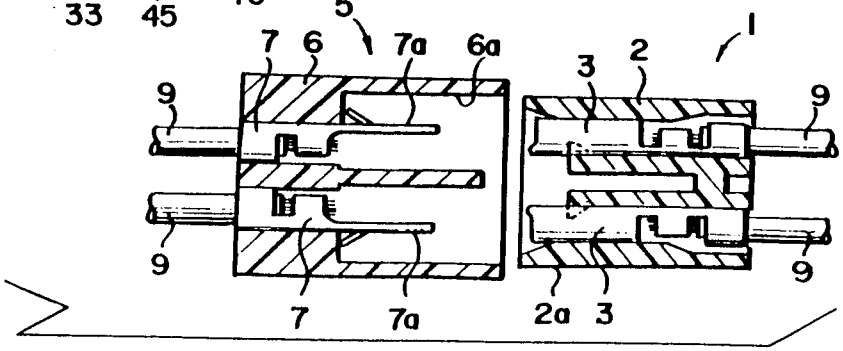
PRIOR ART FIG. 4

ELECTRICAL CONNECTOR HAVING POSITIONING MEMBER TO ALIGN CONTACT SECTIONS OF ELECTRICAL CONTACTS

FIELD OF THE INVENTION

This invention relates to electrical connectors and more particularly to electrical connectors having a positioning member to align contact sections of electrical contacts and to maintain the electrical contacts in the housing.

BACKGROUND OF THE INVENTION

A prior art electrical connector is shown in FIG. 4, which comprises a plug connector 1 having a plug housing 2 which receives and retains a plurality of receptacle contacts 3 to which end portions of wires 9 are connected, and a cap connector 5 having a cap housing 6 which receives and retains a plurality of plug contacts 7 to which end portions of wires 9 are connected. To connect the connectors 1 and 5, a front end 2*a* of the plug housing 2 is inserted in a cavity 6*a* of the cap housing 6, and front ends 7*a* of the plug contacts 7, which project inside the cavity 6*a*, are electrically connected with respective receptacle contacts 3. Thus, an electrical connection between the contacts 3 and 7 is made.

In this case, when the contact sections or front ends 7*a* of the plug contacts 7 are misaligned in the vertical or lateral direction, the front ends 7*a* of the plug contacts 7 cannot be properly mated with the receptacle contacts 3. Accordingly, although the front end 2*a* of the plug housing 2 is inserted in the cavity 6*a*, the front ends 7*a* of the plug contacts 7*a* are not correctly aligned with the receptacle contacts 3, therefore a problem of an incomplete electrical connection between the contacts 3 and 7 occurs.

To prevent such an incomplete connection, a position alignment gauge was used to position the front ends of the plug contacts in alignment with the receptacle contacts after fitting the plug contact in the cap housing. However, this meant that the position alignment gauge had to be used on all of the cap connectors which slowed the assembly operation in addition to increasing the cost of the connectors.

SUMMARY OF THE INVENTION

In consideration of the above-mentioned problems, the purpose of this invention is to provide an electrical connector in which the misalignment of the contacts retained in the cap housing is overcome, thus preventing an incomplete electrical connection.

According to the present invention, a positioning member is inserted in a cavity in a cap housing of an electrical connector, and front ends or contact sections of plug contacts retained in passages in the cap housing extend inside the cavity after extending through positioning holes in the positioning member, thereby positioning the front ends of the plug contacts so as to be in alignment with the receptacle contacts secured in a plug housing and properly electrically mate therewith when the cap and plug housing are mated.

Further, entrance portions of the positioning holes of the positioning member are chamfered so that when the positioning member is inserted in the cavity, the plug contact front ends are guided by these chamfered entrances when being inserted in and extending through the positioning holes. In addition, the positioning member includes projections that cooperate with integral latching arms of the housing thereby maintaining the latching arms in their latching position with the electrical contacts.

Also, since the front ends of the plug contacts are retained in position by the positioning member, any deviation or bending of the front ends can be corrected.

Further, when inserting the positioning member into the housing cavity, if the deviation or bending of the front ends is over a permissible limit, and the front ends cannot be guided into the positioning holes even by the chamfers of the positioning holes, this can be detected without using a position alignment gauge because the positioning member cannot be inserted into position in the cavity.

In addition, if the contacts are not properly seated in their respective passages, the projections of the positioning member will not cooperate with the latching arms thereby preventing the positioning member from being inserted into position in the cavity.

Moreover, a retaining member for retaining the contacts in position in their passages in the housing includes projections that cooperate with latching members to maintain the latching members in latching engagement with the contacts.

BRIEF DESCRIPTION OF THE DRAWINGS

FIG. 1 is a cross-sectional view showing a cap connector according to this invention when engaged and connected with a matable plug connector.

FIG. 4 is a cross-sectional view showing a prior art cap connector and plug connector.

DETAILED DESCRIPTION OF THE INVENTION

The following is a preferred embodiment of this invention by way of example with reference to the drawings.

Figure 2:
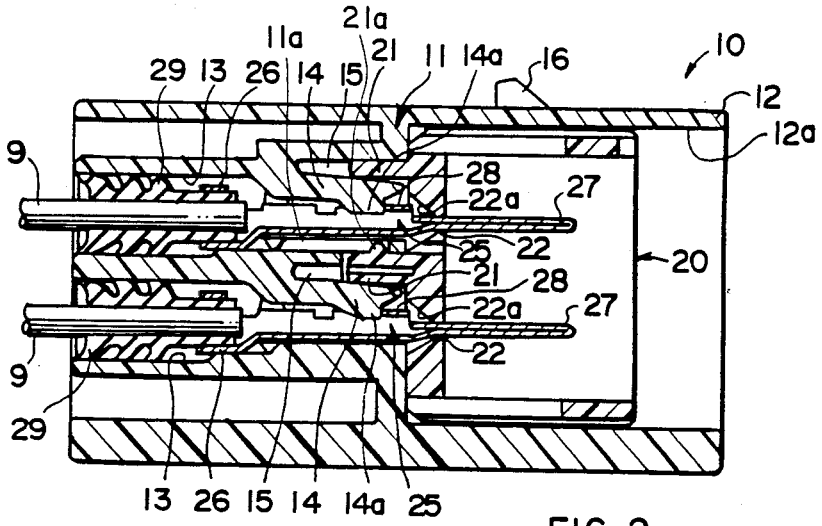
FIGS. 2 and 3 are cross-sectional views respectively showing the above cap connector and plug connector.

The cap connector 10 as shown in FIGS. 1 and 2 comprises a cap housing 11, a positioning member 20, and a plurality of plug contacts 25. The cap housing 11 is made of an insulation material, for example, plastic, and has a hollow portion 12 on the right side, as best shown in FIG. 2, defining a cavity 12*a* opening to the right, and a portion on the left side having a plurality of contact passages 13 opening to the left and extending into the cavity 12*a* . Plug contacts 25 are connected to wires 9 at the rear portion 26 thereof. Plug contacts 25 are retained in position in passages 13 in such a way that the front ends or contact sections 27 of the plug contacts 25 extend into or along the cavity 12*a*, as shown in FIG. 2.

A resilient latching arm 14 is provided inside the contact passages 13, and when the plug contacts 25 are inserted in the contact passages 13, latching projection 14*a* formed at an under surface of the resilient latching arm 14 is engaged with a shoulder 28 of the plug contacts 25 and retained thereagainst by the flexibility of the resilient latching arm 14. Therefore, once the plug contacts 25 are inserted in to the contact passages 13, the plug contacts 25 are retained therein. Further, this connector 10 can be made waterproof by fitting the terminated ends of the wires 9 with a rubber plug 29 having annular sealing sections and inserting them in the contact passages 13 together with the plug contacts 25, thus preventing the ingress of water into the connector.

Accordingly, after a plurality of plug contacts 25 have been latchably secured in passages 13 via latching arms 14 in the cap housing 11, the positioning member 20 is then inserted in the cavity 12*a*. Positioning member 20 is box-shaped and open to the right as shown in FIG. 2, and it has positioning holes 22 in the rear wall which extend therethrough at positions corresponding to the front ends or contact ends 27 of the plug contacts 25 which extend into and along the cavity 12*a*. The entrances of the positioning holes 22 has a chamfer 22*a*. When the positioning member 20 is inserted in the cavity 12*a*, the front ends 27 of the plug contacts 25 are guided through the positioning holes 22 by the chamfers 22*a*, and then project into the cavity 12*a* after extending through the positioning holes 22. Therefore, even if the front ends 27 extending along the cavity 12*a* are slightly misaligned or bent, the front ends 27 can be guided into the positioning holes 22 by the chamfers 22*a*.

Therefore, the alignment or bending of the front ends 27 can be corrected by the positioning holes 22. Moreover, when the front ends 27 are being guided into the positioning holes 22 by the chamfers 22, if the permissible misalignment or bending of the front ends 27 is excessive, the positioning member 20 cannot be inserted in the cavity 12*a*, thus the excessive misalignment or bending can be detected. Namely, a slight misalignment or bending can be corrected by the positioning holes 20, and a large misalignment or bending can be detected by the positioning member 20. Thus, examination with a position alignment gauge is not required.

The positioning member 20 is provided with retaining projections 21 which project toward the left as shown in FIGS. 1 and 2. These retaining projections 21 are aligned with the spaces 15 above the resilient latching arms 14 of the cap housing 11. Retaining projections 21 are inserted into the spaces 15 when the positioning member 20 is inserted into the cavity 12*a*. When the retaining projections 21 are inserted into the spaces 15, deformation of the resilient latching arm 14 is suppressed by the retaining projections 21, and thus the plug contacts 25 are retained in place in passages 13.

One of the projections 21 is split into two sections with one section lug 21*a* that mates with a slot 11*a* in housing 11 thereby latching positioning member 20 in position in housing 11.

Also, if a plug contact 25 is not fully inserted in passages 13, the latching projection 14*a* of latching arm 14 is disposed on the plug contact 25 without engaging with the shoulder 28, space 15 is reduced by elastic deformation of the resilient latching arm 14, therefore, the retaining projection 21 cannot be inserted in space 15. Consequently, the positioning member 20 cannot be inserted in the cavity 12*a*, and thus an incomplete insertion of the plug contacts 25 in passages 13 can be detached.

Thus, positioning member 20 also operates as a retaining member retaining plug contacts 25 in position in passages 13 as well as positively indicating proper positioning or seating of plug contacts 25 in passages 13.

Latching projection 16 is located at an upper surface of the cap housing 11 to cooperate with a latching arm on plug housing 31 to maintain the cap housing 11 with the plug housing 31.

Figure 3:
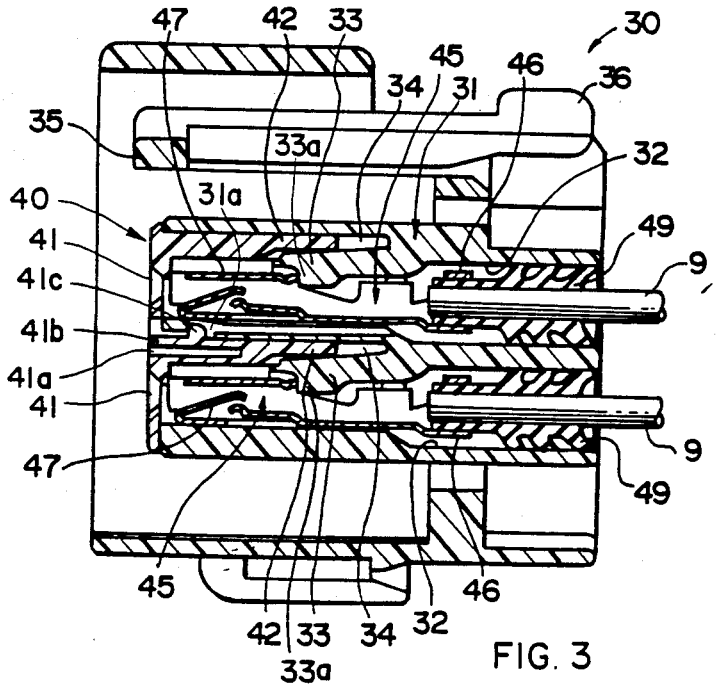

Plug connector 30 which is mated and connected with the cap connector as shown in FIG. 10 comprises a plug housing 31, a retaining member 40 and a plurality of receptacle contacts 45. The plug housing 31 as shown in FIG. 3 has a plurality of contact passages 32 extending therethrough and the receptacle contacts 45 are inserted in the contract passages 32 from the right side of FIG. 3. The front end of each receptacle 45 is provided with receptacle portion 47 wherein the contact section 27 of each plug contact 25 is inserted, and a wire 9 is connected to the rear end portion 46 thereof. Rubber plug 49 having annular sealing sections is fitted on the end portion of the wire 9 via portion 46. A resilient latching arm 33 is provided in the contact passage 32, in the same way as for the cap connector 10, and latching projection 33*a* on the resilient latching arm 33 is engaged with a shoulder of the receptacle contact 45 thereby maintaining receptacle contact 45 within passage 32.

Retaining member 40 is inserted in the plug housing 31, which retains the receptacle contacts 45 therein. The retaining member 40 has at the left end portion thereof insertion apertures 41 which are in alignment with receptacle portions 47, and retaining projections 42. The insertion apertures 41 which have chamfered entrances allow the front ends 27 of the plug contacts 25 to pass therethrough and connect with the receptacle portions 47 of the receptacle contacts 45 when the plug connector 30 is connected with the cap connector 10. The retaining projections 42 are disposed in spaces 34 and suppress the deformation of resilient latching arms 33, as in the case of the cap connector 10, and accordingly, securely retains latching projections 33*a* of latching arms 33 in engagement with the shoulders of the receptacle portions 47.

A slot 41*a* is provided in a front end of retaining member 40 forming a flexible section 41*b* having a lug 41*c* that mates with a slot 31*a* in housing 31 thereby latching retaining member 40 in position in housing 31.

Also, provided at an upper portion of the plug housing 31 in FIG. 3 is latching arm 35, which engages with the latching projection 16 on cap housing 11 when the plug housing 31 is connected with the cap housing 11. Latching arm 35 includes a release end 36 which releases engagement between the latching arm 35 and the latching projection 16 when a force is applied to end 36.

When the engagement of both connectors is conducted by inserting the plug connector 30 into the cavity 12*a* of the cap connector 10, the front ends 27 of the plug contacts 25 are electrically engaged with the receptacle portions 47 of the receptacle contacts 45 through the insertion apertures 41 of the retaining member 40, and thus an electrical connection between both contacts is established as shown in FIG. 1. Accordingly, when both connectors 10 and 30 are engaged and connected, the latching arm 35 of the plug housing 11 engages with the latching projection 16 of the cap housing 11, and thus this connection is retained. Also a waterproofing sealing member 50 is provided on the plug housing 31 as shown in FIG. 1, to prevent the ingress of water.

As explained above, according to the present invention, since the positioning member is inserted into the cavity of the cap housing and the front end contact sections of the plug contacts extend into the cavity while passing through the positioning holes formed in the positioning member; therefore, isalignment or bending of the contact sections is prevented. Also, when the positioning member is inserted, the contact sections of the plug contacts are guided by the chamfers formed at the entrance portions of the positioning holes to enter the positioning member, therefore, any slight misalignment or bending at the contact sections of the plug contact can be corrected. Further, since the positioning member cannot be inserted when the misalignment or bending of the contact sections is so large that they can not be guided by the chamfers, a defective connector can be detected without using a position alignment gauge. In addition, the positioning member includes projections that cooperate with resilient latching members maintaining the contacts in position in the contact passages or preventing the positioning member from being positioned in the cavity if the contacts are not properly latched by the latching members. Moreover, a retaining member is disclosed for retaining electrical contacts in position in their passages in a housing which includes projections that cooperate with latching arms to maintain the latching arms in latching engagement with the contacts.

I claim:

1. An electrical connector comprising a plurality of electrical plug contacts which are electrically connectable with mating electrical receptacle contacts having end portions connected to wires, and a cap housing having a cavity wherein a mating connector is received, and said plug contacts being retained in such a manner that contact sections of said plurality of plug contacts extend into said cavity, and an electrical connection is formed between both of said plug and receptacle contacts by inserting said mating connector in said cavity and engaging said contact sections of said plug contacts with said receptacle contacts received and retained in said mating connector, characterized in that:

said electrical connector includes a rigid positioning member insertable in said cavity of said cap housing, comprising means for laterally and vertically aligning said contact sections of said plug contacts extending through positioning holes in said positioning member when said positioning member is inserted in said cavity.

2. An electrical connector as claimed in claim 1, characterized in that entrance portions of said positioning holes of said positioning member are chamfered for guiding said contact sections through said positioning holes.

3. An electrical connector as claimed in claim 1, characterized in that said cap housing has passages in which said plug contacts are respectively retained, resilient latching arms provided in said passages resiliently engaging said plug contacts therein thereby latchably retaining said plug contacts therein.

4. An electrical connector as claimed in claim 3, characterized by a space between the passage walls and the resilient latching arms, said positioning member including projections disposed in the spaces thereby maintaining the latching arms in engagement with the plug contacts.

5. An electrical connector, comprising:

an insulating housing member having contact-receiving passages and a cavity in communication with one another;

electrical contact members having terminating sections disposed in said passages and contact sections extending into and along said cavity; and a rigid positioning member disposed in said cavity and having positioning holes in a rear wall thereof, said contact sections extending through said position holes when said positioning member is disposed in said cavity so that said positioning holes vertically and laterally align said contact sections along said cavity for matable electrical engagement with complementary electrical contact members of a matable electrical connector.

6. An electrical connector as claimed in claim 5, wherein said positioning holes have chamfered entrances.

7. An electrical connector as claimed in claim 5, wherein said passages have resilient latching arms in engagement with said electrical contact members latchably retaining said contact members in said passages.

8. An electrical connector as claimed in claim 7, wherein a space is provided between walls of said passages and said resilient latching arms, said positioning member having projections disposed in the spaces thereby maintaining the latching arms in engagement with the contact members.

9. An electrical connector, comprising:

a dielectric housing member having contact-receiving passages;

electrical contact members in said contact-receiving passages;

resilient latching arms extending from walls of said contact-receiving passages in engagement with contact members retaining said contact members in position in said contact-receiving passages, said latching arms and the walls of the passages having a space therebetween; and a retaining member in said housing member having projections disposed in the spaces between the passage walls and the latching arms thereby maintaining the latching arms in engagement with the contact members characterized in that said housing member includes a cavity along which said retaining member extends, said retaining member having an inner wall including positioning holes through which contact sections of said contact members extend into and along said cavity, said positioning holes serving to align said contact sections when said retaining member is positioned in said cavity.

10. An electrical connector as claimed in claim 9, wherein said positioning holes have chamfered entrances.

11. An electrical connector as claimed in claim 9, wherein said contact members have terminating sections terminated to ends of electrical wires, sealing members surrounding the wire ends and secured thereto by said terminating sections, said sealing members sealingly engaging the contact-receiving passages.

12. An electrical connector as claimed in claim 9, wherein said retaining member includes a latching member latchably engageable with a slot in said housing member.

13. An electrical connector, comprising:

a dielectric housing member having contact-receiving passages;

electrical contact members having receptacle contact sections in said contact-receiving passages;

resilient latching arms extending from walls of said contact-receiving passages in engagement with said contact members to retain said contact members in position in said contact-receiving passages, said latching arms and the walls of the passages having a space therebetween; and a retaining member in said housing member having projections disposed in the spaces between the passage walls and the latching arms thereby maintaining the latching arms in engagement with the contact members, said retaining member having holes in alignment with said receptacle contact sections.

14. An electrical connector as claimed in claim 13, wherein said holes have chamfered entrances.

* * * * *